United States Patent [19]

Courtney

[11] Patent Number: 4,681,552

[45] Date of Patent: Jul. 21, 1987

[54] COMBINED LIFE VEST DEVICE AND BUOYANCY COMPENSATOR

[76] Inventor: William L. Courtney, 3000 Steiner St., San Francisco, Calif. 94123

[21] Appl. No.: 747,005

[22] Filed: Jun. 20, 1985

[51] Int. Cl.[4] ..... B63C 9/16; B63C 9/18

[52] U.S. Cl. ..... 441/92; 441/108; 441/115

[58] Field of Search ..... 405/186; 441/102, 103, 441/106, 108, 111, 112, 114–119, 92, 96, 104; 128/202–214

[56] References Cited

U.S. PATENT DOCUMENTS

| | | | |
|---|---|---|---|
| 3,436,777 | 4/1969 | Greenwood | 405/186 |
| 3,747,140 | 7/1973 | Roberts | 405/186 |
| 4,016,616 | 4/1977 | Walters | 405/186 |
| 4,137,585 | 2/1979 | Wright, III | 128/202.14 X |
| 4,176,418 | 12/1979 | Scott | 128/202.14 X |
| 4,324,234 | 4/1982 | Maness | 128/202.14 |

*Primary Examiner*—Sherman D. Basinger
*Attorney, Agent, or Firm*—John A. Bucher

[57] ABSTRACT

A combined life vest device and buoyancy compensator is disclosed for use by divers along with scuba gear including a back pack for mounting a compressed air tank on the back of the diver. One embodiment of the invention comprises a single garment for the diver including inner and outer shells providing abrasion protection with first and second airtight chambers forming respectively a buoyancy compensator adjacent the compressed air tank and a part of life vest surrounding the diver's torso. A conventional power inflator is employed for regulating pressure within the buoyancy compensator. An inflating device for the second chamber preferably includes an interconnection between the two chambers with a one-way check valve so that the second chamber is automatically inflated when pressure in the first chamber exceeds a predetermined level. A rebreathing tube is provided in communication with the second chamber so that the diver may use it as an emergency air supply. In another embodiment, the first chamber is also arranged adjacent the air tank while being separable from the second chamber in order to permit it to remain with the tank. In that embodiment, the first and second chambers are similarly interconnected as described in the first embodiment while also including a quick release coupling to facilitate separation of the chambers.

22 Claims, 7 Drawing Figures

COMBINED LIFE VEST DEVICE AND BUOYANCY COMPENSATOR

FIELD OF THE INVENTION

The present invention relates to scuba gear and more particularly to a combined life vest device and buoyancy compensator for use by divers with other scuba gear.

BACKGROUND OF THE INVENTION

A wide variety of designs for scuba gear have been disclosed in the prior art to facilitate use of the gear by divers. It is of course important for the diver to be able to rapidly and effectively manipulate the scuba gear for providing an under water source of oxygen or air to the diver, for regulating buoyancy of the diver under water and for permitting the diver to return to the surface, possibly under emergency conditions.

In the event that the diver desires to return to the surface, particularly under emergency conditions, the safety of the diver is of course of primary importance. However, it is also desirable that he be above to either keep the scuba gear with him as he returns to the surface or assure that the scuba gear will return to the surface by itself because of its relative expense.

As is well known at least among those who commonly use such gear for under water diving, the term "scuba" is an acronym for self contained, under water breathing apparatus. Scuba apparatus or gear commonly includes a tank containing compressed air in order to provide the diver with an underwater supply of air or oxygen. The tank is commonly mounted on the diver's upper torso or back by means of a suitable back pack. Scuba gear also commonly includes a buoyancy compensator which the diver wears and can selectively pressurize in order to adjust his buoyancy under water.

Scuba gear for use in situations of the type outlined above was disclosed in a copending U.S. patent application Ser. No. 664,238, entitled SCUBA GEAR WITH COMBINED FLOTATION AND TRANSPORT DEVICE, filed on Oct. 24, 1984 by the inventor of the present invention. The above reference related to a back pack including quick release means so that the diver could readily free himself from the compressed air tank. An inflatable transport raft was secured to the tank for the purpose of returning the tank to the surface and also to provide transport means for the diver on the surface of the water. That copending application is incorporated herein as though set out in its entirety to assure a more complete understanding of the present invention since certain features from that reference are included in the following disclosure. Various combinations of components for scuba gear have been disclosed in other patents. For example, Maness U.S. Pat. No. 4,324,234 disclosed a personal flotation device containing two structurally and functionally independent chambers for assisting pilots and other passengers in heliocopters and the like to escape after crashing in the ocean. The Maness patent also disclosed a rebreathing tube to permit the wearer to use the flotation device as an emergency air supply.

Other prior art references include, for example, Walters U.S. Pat. No. 4,016,616 issued Apr. 12, 1977; Scott U.S. Pat. No. 4,176,418 issued Dec. 4, 1979; and Roberts U.S. Pat. No. 3,747,140 issued July 24, 1973.

The Scott patent disclosed apparatus for regulating pressurization of a buoyancy compensator from a tank of compressed air. The apparatus of the type disclosed by Scott also has commonly included means for permitting the diver to manually inflate the buoyancy device by blowing into a mouthpiece associated therewith. Emergency sources of compressed gas have also been commonly provided for use by the diver.

The Roberts patent disclosed the use of inflation apparatus with a quick release coupling for interconnecting a compressed air tank with a buoyancy compensator in the form of an inner tube. The buoyancy compensator disclosed in the Roberts patent is of a type fitting about the diver's neck and sometimes referred to as a "horse collar".

The Walters patent disclosed similar scuba gear with an inflatable buoyancy compensator secured to the compressed air tank and mounted on the diver's back by the same back pack used for the tank. Through this combination, the diver could inflate the buoyancy compensator in order to adjust his effective under water weight or buoyancy. As noted in the Walters patent, it is not always possible to accurately predict the amount of extra weight a diver must wear in order to achieve neutral or slightly negative buoyancy. Accordingly, buoyancy compensators are commonly provided with inflation apparatus permitting the diver to inflate the buoyancy compensator as necessary in order to establish and maintain desired buoyancy.

In addition to problems of the type referred to above, it is also desirable for a diver to be able to deal with or overcome difficulties in a variety of other situations. For example, when a diver removes his compressed air tank before returning to the surface, under emergency conditions or otherwise, it is desirable to provide flotation means for returning the tank and other scuba gear components to the surface. At the same time, it is also desirable to provide flotation means for assisting the diver himself in returning to the surface. In the combination of the Walters patent, it is noted again that the buoyancy compensator remained permanently attached to the tank and thus was not available for assisting the diver.

Also, in a number of designs for scuba gear, a buoyancy compensator surrounds the torso of the diver and, upon being inflated, tends to interfere with the diver's underwater movements, particularly movement of his arms.

Otherwise, it has also been found desirable if not necessary to provide other improvements in scuba gear for facilitating use and manipulation of the gear by divers in underwater conditions. Accordingly, there has been found to remain a need for improved scuba gear capable of facilitating operation of the gear under water and to make it easier for divers to return to the surface when desired or necessary.

SUMMARY OF THE INVENTION

It is therefore an object of the invention to provide a combined life vest device and buoyancy compensator for use by divers along with scuba gear including back pack means for mounting a compressed air tank on the diver's back. The combined life vest device and buoyancy compensator comprises a garment worn by the diver and includes buoyancy compensator means in the form of a first air-tight chamber formed in the garment closely adjacent the location of the tank. With the buoyancy compensator in this position, it tends to maintain the diver's usual center of gravity while under water.

The garment also includes life vest means in the form of a second chamber generally surrounding a portion of the diver's torso. With this combination, pressure in the buoyancy compensator chamber may readily be adjusted in order to maintain desired buoyancy for the diver. At the same time, the life vest chamber may be left uninflated to provide greater freedom of movement for the diver.

The device of the invention also preferably includes fixed buoyancy, for example, in the form of closed cell foam in order to comply with certification requirements established for life vests by agencies such as the U.S. Coast Guard.

Combined life vest device and buoyancy compensator preferably comprises an interconnection between the two chambers with a one-way check valve so that the life vest can be inflated when pressure in the buoyancy compensator chamber exceeds a predetermined level. The invention even more preferably includes alarm means for notifying the diver before or as inflation of the life vest is initiated.

In one embodiment of the invention, the buoyancy compensator chamber and life vest chamber are both formed in complementary relation to each other in a single garment. In another embodiment, the buoyancy compensator chamber is separable from the life vest chamber in order to remain with the tank when it is removed by the diver. In that embodiment, a quick release coupling is provided in the interconnection between the chambers to facilitate separation as described above.

Combined life vest device and buoyancy compensator of the present invention is formed with inner and outer shells to provide abrasion protection for flexible containers forming the chambers. A wet suit may form the inner liner if desired or the device may be constructed separately for use with or without a wet suit.

Additional objects and advantages of the invention are made apparent in the following description having reference to the accompanying drawings.

DESCRIPTION OF THE PREFERRED EMBODIMENTS

Figure 1:
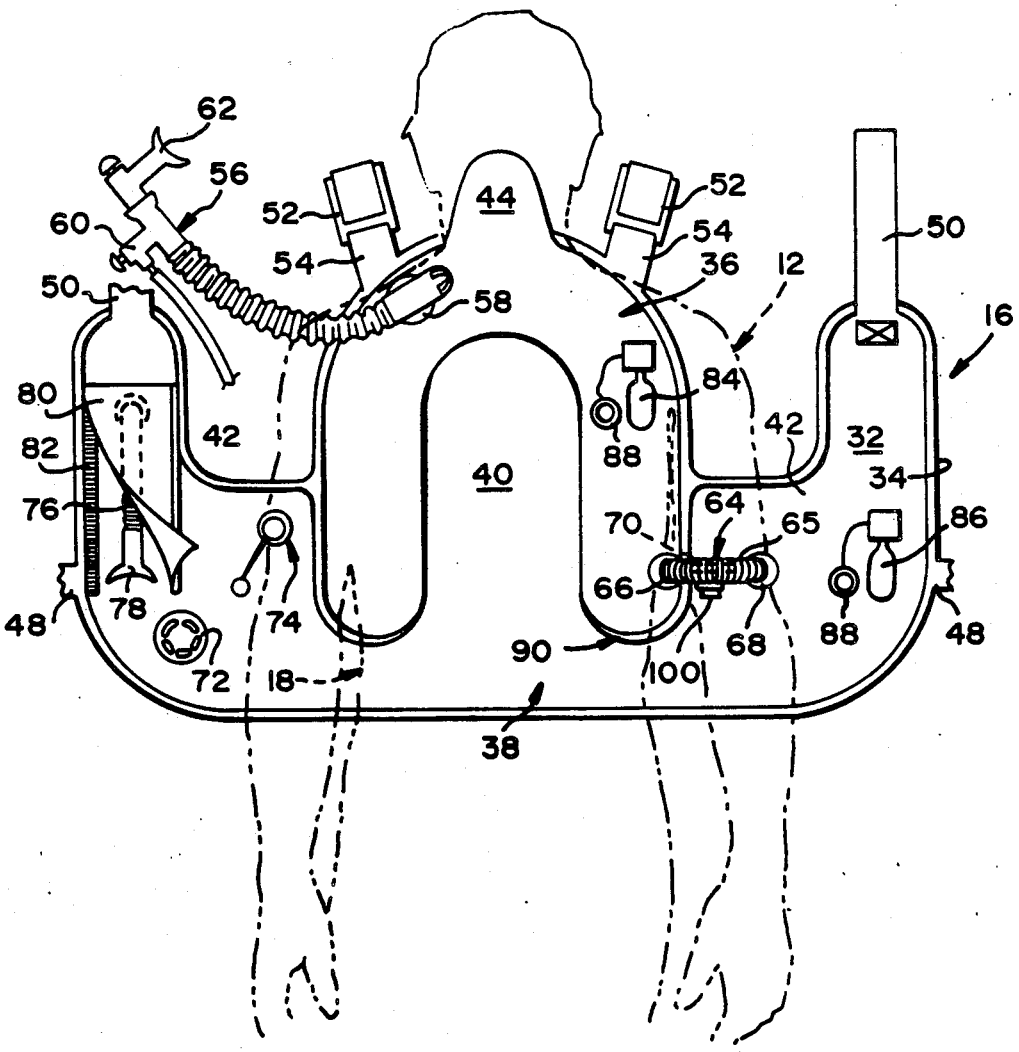
FIG. 1 is a view of the combined life vest device and buoyancy compensator of the present invention shown generally in developed or spread out fashion, with the outline of a diver being shown in broken lines to illustrate the construction of the device and the manner of its use by the diver.
Figure 3:
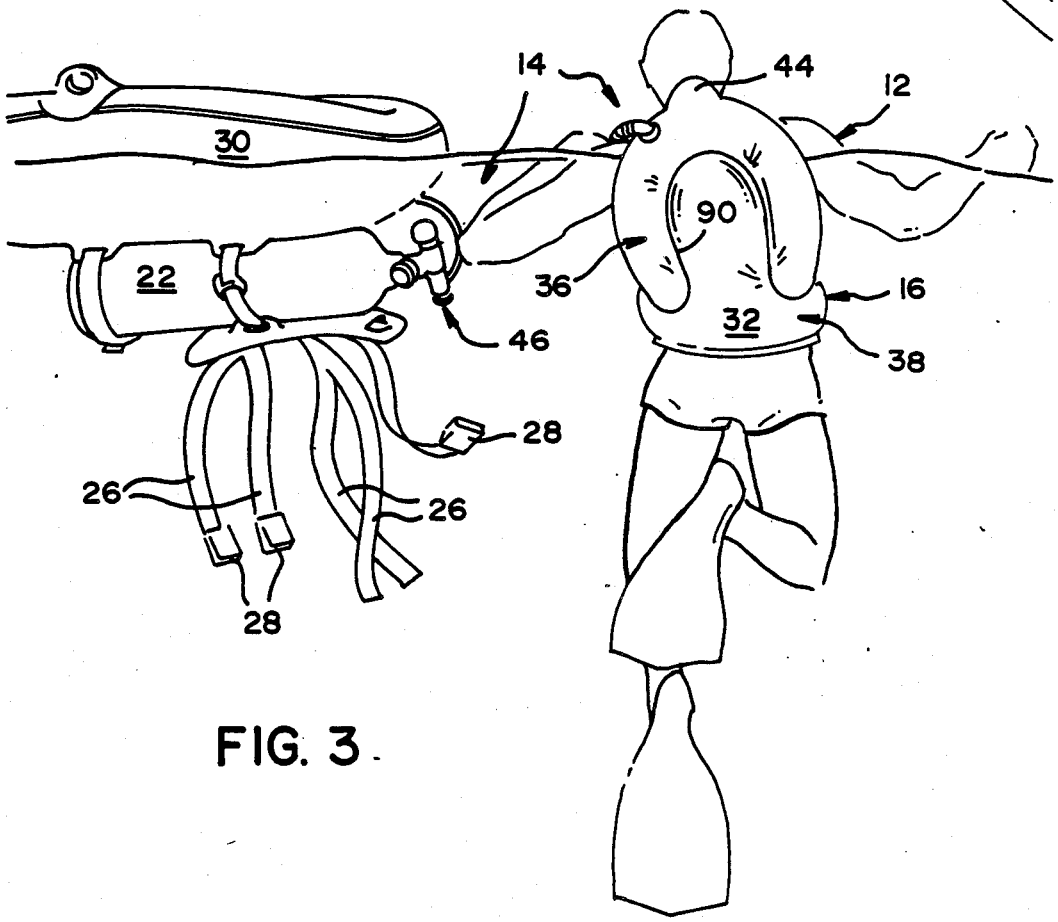
FIG. 3 is a similar pictorial representation of the diver after returning to the surface and with the life vest portion or chamber of the device also being inflated to provide flotation for the diver.
Figure 5:
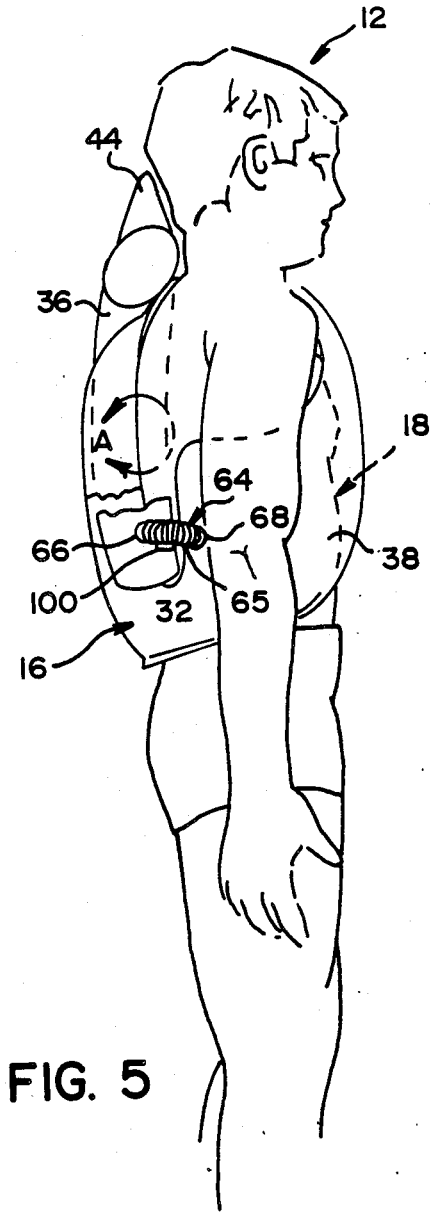
FIG. 5 is similarly a side view of a diver with both the buoyancy compensator and life vest chambers of the device being inflated.
Figure 4A:
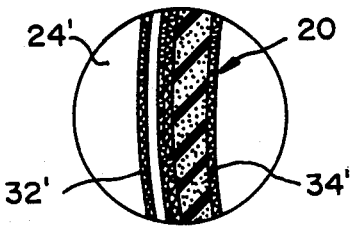
FIG. 4*a* is an enlarged fragmentary view taken from FIG. 4 as indicated.
Figure 5A:
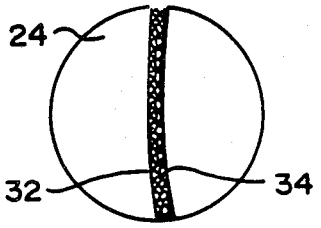
FIG. 5*a* is an enlarged fragmentary view taken from FIG. 5.

Referring now to the drawings and particularly to FIGS. 3 and 5, a diver 12 is illustrated wearing scuba gear generally indicated at 14 which is constructed in accordance with the present invention. Combined life vest device and buoyancy compensator of the present invention is generally indicated at 16. In FIG. 1, the combined life vest device and buoyancy compensator 16 is shown in developed or spread out fashion to better illustrate its construction with the diver 12 being shown in broken lines to demonstrate the manner in which the device 16 is positioned with respect to the diver's torso 18.

Figure 2:
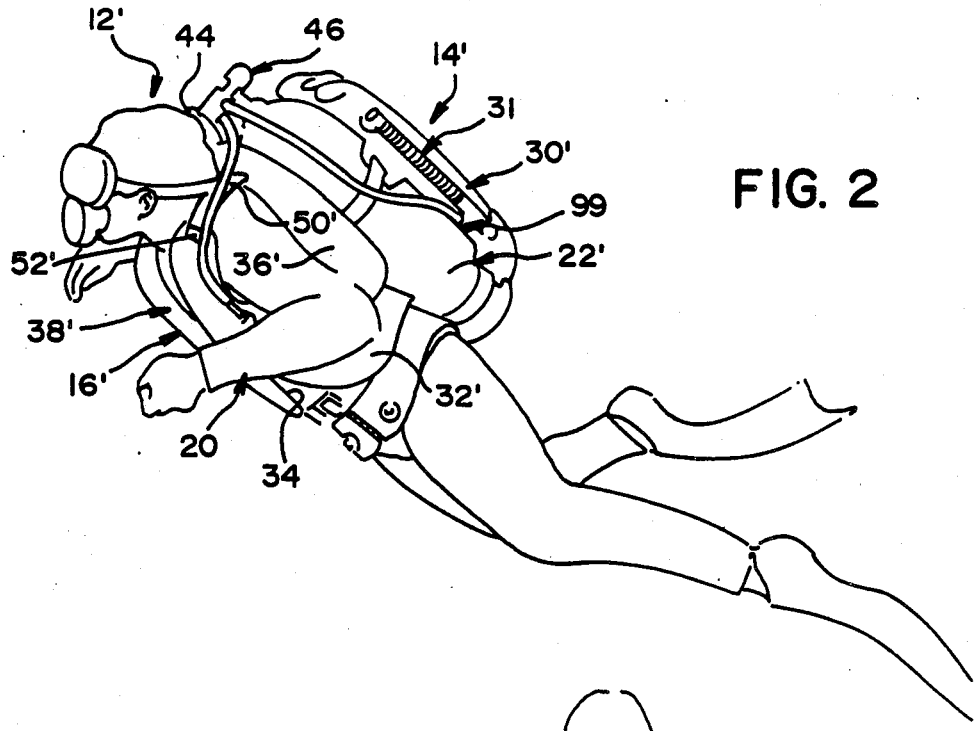
FIG. 2 is a pictorial representation of a diver while under water with the buoyancy compensator portion or chamber of the device being inflated.
Figure 4:
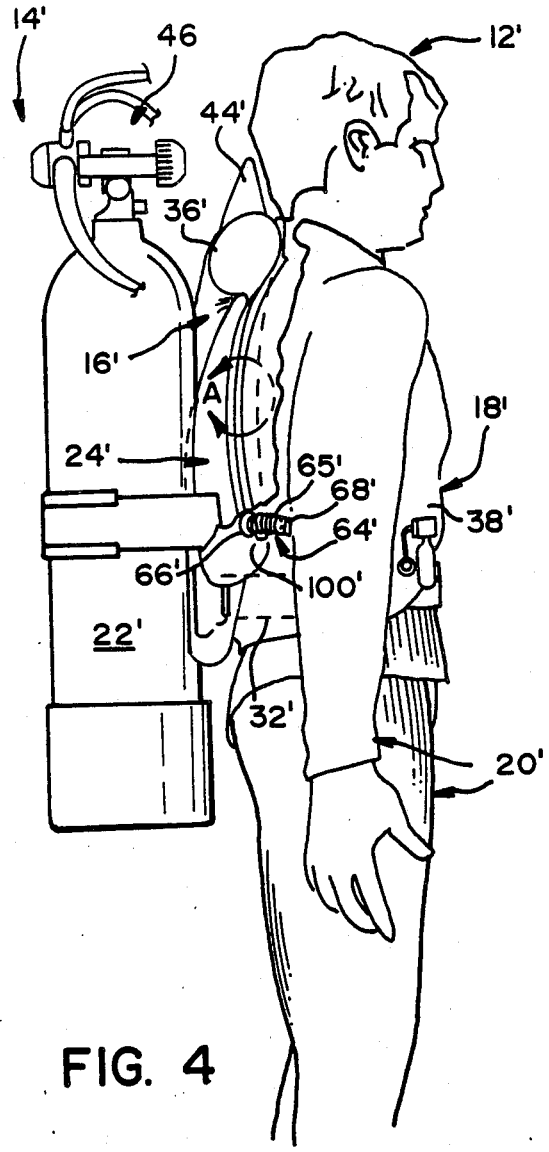
FIG. 4 is a side view of the diver with only the buoyancy compensator chamber being inflated, FIGS. 2 and 4 showing a different embodiment of the invention from FIGS. 1, 3 and 5.

Another embodiment of the combined life vest device and buoyancy compensator of the present invention is illustrated in FIGS. 2 and 4. The embodiment of FIGS. 2 and 4 includes substantially the same features and components as the device of FIGS. 3 and 5 while employing a conventional wet suit 20 as an inner portion or shell of the device. In that embodiment, the wet suit provides the necessary fixed buoyancy referred to above. Accordingly, the combined life vest device and buoyancy compensator illustrated in FIGS. 2 and 4 along with the wet suit 20 is indicated at 16'.

The wet suit 20 provides the fixed buoyancy required for life vest certification as noted above. This fixed buoyancy is commonly provided by a closed cell foam available for example under the trademark NEOPRENE in the wet suit to develop a minimum buoyancy of, for example, $10\pm0.5$ pounds in the event of failure of all inflatable chambers. With the addition of the buoyancy from inflation of the life vest and buoyancy compensator chambers, total buoyancy approaches fifty to seventy pounds, for example, and assures a safe and secure position for the diver when at the surface of the water.

Otherwise, referring in combination to FIGS. 1–5, the scuba gear 14 comprises a compressed air tank 22 which is adapted for attachment to the diver's back or torso 18 by means of a backpack generally indicated at 24. Referring particularly to FIG. 3, the backpack 24 is worn externally of the device 16 or 16' by the diver and includes straps 26 with quick release couplings 28 to facilitate removal of the tank by the diver when desired in generally conventional fashion. In use, the straps 26 are arranged about the diver's waist and shoulders to position the backpack and tank in the manner best illustrated in FIGS. 2 and 4.

It may be seen from those Figures that the straps 26 are designed to fit around the combined life vest device and buoyancy compensator to further facilitate removal of the tank by the diver while leaving the device 16 in place upon the diver.

An inflatable transport raft 30 is preferably secured to the tank 22 and is usable both as a buoyancy device for carrying the tank 22 to the surface of the water and also to provide transport for the diver 12 on the surface of the water. The construction and operation of the raft 30 is described in the copending reference noted above and accordingly is not described in greater detail herein.

The combined life vest device and buoyancy compensator 16 illustrated in FIGS. 1, 3 and 5 is preferably constructed as a single garment having an outer liner 32 providing abrasion resistance for the garment and an inner liner 34 positioned next to the diver's body. Referring momentarily to the other embodiment of the device indicated at 16' in FIGS. 2 and 4, the inner shell 34 is attached to a full wet suit 20 in the embodiment 16'. The garment may be designed for separation from the wet suit, for example, by means of zippers or fabric fasteners, to permit use of the device with different wet suits or to permit replacement of the wet suit for example if it were to wear out faster than the device 16'. On the other hand, the device may be formed as an entirely separate garment as illustrated for example at 16 in FIGS. 1, 3 and 5 so that it may be used either with or without a wet suit. As noted above, the wet suit provides a critical or minimum amount of fixed buoyancy.

The following comments are directed toward the embodiment 16 of the combined life vest device and buoyancy compensator. However, it is to be noted that the other embodiment of the device as indicated at 16' includes all the same features. Accordingly, similar features in the device 16' are also indicated by similar primed numerals.

Referring now particularly to FIG. 1, the device or garment 16 is formed with a first air-tight chamber or flexible container 36 forming a buoyancy compensator and arranged closely adjacent the air tank 22 when worn by the diver as best seen in FIGS. 4 and 5. A second air-tight chamber or flexible container 38 is also formed in the garment between the liners 32 and 34. The second chamber 38 is designed to wrap about at least a portion of the diver's torso 18 in order to provide an optional flotation device for the diver.

As is illustrated in FIG. 1 the second chamber or flexible container 38 has a W-configuration with an elongated central element or portion 40 extending along the diver's back. Referring also to FIGS. 2 and 4, it may be seen that the tank 22 and backpack 24 are positioned directly over the central portion 40. Elongated lateral portions 42 of the second chamber or container 38 are interconnected with the central portion 40 while being arranged to lie adjacent the diver's chest or the front of his torso as may be best seen in FIGS. 2, 4 and 5.

At the same time, the first chamber or container 36 has an inverted U-configuration so that it extends transversely behind the diver's neck and downwardly to surround the air tank 22 when it is in place upon the diver's back as shown in FIGS. 2 and 4. In addition, the U-configuration of the first chamber 36 complements and nests within the elements of the W-configuration for the second chamber or container 38 to provide greater comfort for the diver. The first chamber 36 also includes a central extension or projection 44 positioned just behind the diver's head to act as a cushion, for example, when the diver raising his head in a manner so that he may accidently bump the controls 46 on the air tank 22.

The device 16 also includes straps or fasteners 48 adapted to secure the device 16 about the diver's waist. At the same time, straps 50 on the lateral portions 42 of the device are designed to pass over the diver's shoulders and engage quick release couplings 52 on additional straps 54 secured to the central portion 40 of the device.

A power inflator 56 is of generally conventional construction to permit regulation of pressure within the first buoyancy compensator chamber 36. Accordingly, the power inflator 56 is connected to the first chamber 36 as indicated at 58 and may be connected with the tank 22 through the controls 46 in conventional fashion. The power inflator 56 includes a mouthpiece 62 and is generally of conventional construction as noted above. Accordingly, it is not described in greater detail herein. The power inflator 56 does provide one function in terms of the present invention in that it serves as a means for regulating pressure within the first buoyancy compensator chamber 36. Another power inflator 31 includes manual means as indicated at 99 for supplying air under pressure to the raft 30.

Other features in the device 16 enabling it to function as contemplated in the present invention are described below. Initially, the second chamber 38 is preferably inflated by a means of an interconnection 64 arranged between the first and second chambers 36 and 38. The interconnection 64 includes a first one-way check valve 66 for releasing air through the interconnection 64 to inflate the second chamber 38 when pressure in the first chamber 36 exceeds a predetermined level, for example, about one pound per square inch (psi). Normal operation of the buoyancy compensator chamber 36 is possible within a pressure range beneath that level. Thus, the diver may employ the power inflator 56 to increase or decrease pressure and thus change buoyancy by means of the chamber 36 while underwater. Either at the time of returning to the surface or after reaching the surface, the diver may then operate the power inflator 56 so that pressure in the buoyancy compensator 36 exceeds that pressure level, causing airflow through the interconnection 64 for inflating the life vest chamber 38.

However, in order to provide a warning to the diver that the life vest chamber 38 is about to be inflated, the interconnection 64 preferably includes a second one-way check valve 68 arranged adjacent the life vest chamber 38 and set at a somewhat higher pressure than the first check valve, for example, two psi. The space in the interconnection 64 between the two check valves comprises a transition space or tube 65 between the first and second chambers.

An indicator for the diver such as a whistle indicated at 70 is arranged within the interconnection 64 between the first and second check valves 66 and 68. Thus, when pressure in the buoyancy compensator 36 exceeds the first predetermined level and causes the first check valve 66 to open, air flow into the interconnection 64 activates the whistle 70 and alerts the diver than further pressurization of the buoyancy compensator will inflate the life vest chamber 38. The diver may then decide whether or not to continue pressurizing the buoyancy compensator Accordingly, this feature avoids accidental inflation of the second chamber 38.

The second life vest chamber 38 is also provided with a high pressure relief valve 72 of generally conventional construction and set for example to relieve air pressure from the second chamber 38 when it exceeds a third (highest) predetermined pressure level, for example, three psi. The relief valve 72 functions in a generally conventional manner to prevent accidental overpressurization of the chambers 38 and 36.

A manually operated relief valve 74 is also provided in communication with the first chamber 36 at 58. Yet another manual relief valve 100 is provided for the transition tube 65 so that the diver may at any time entirely dump all pressure from the two chambers 36 and 38 and the transition tube 65.

In certain underwater situations, the diver may free himself from the tank 22 and backpack 24 before he returns to the surface of the water. In such an event, he may at times require a supply of air after he has separated himself from the tank and before he returns to the surface. For that purpose, a rebreathing tube 76 is connected with the second chamber 38 and includes a mouthpiece 78 so that the diver or even a companion may rebreathe air from the second chamber 38 for a short period of time. Normally, the rebreathing tube 76 is secured by means of a flap 80. Normally, the flap 80 is secured over the rebreathing tube 76 by means of a quick release cloth fastener 82.

As is common practice with such devices, an emergency supply of air is provided by means of a compressed carbon dioxide canister 84 for the first chamber 36. A similar emergency canister 86 is also provided for the second chamber 38. Both of the emergency canisters 84 and 86 include manual means 88 permitting the diver to use the canisters for respectively pressurizing the first chamber 36 or second chamber 38. In order to better adapt the second chamber 38 as a rebreathing source through the tube 76, the canister 86 is filled with oxygen. Preferably, the canister 84 is also filled with oxygen.

As illustrated in FIG. 1, the first and second chambers 36 and 38 are joined at a seam 90 formed by the garment or device 16. However, in another embodiment contemplated for the invention, the first chamber or container 36 may be separable from the second chamber or container 38 to permit the first chamber 36 to remain with the air tank 22 and backpack 24 when they are removed by the diver. For example, if the tank 22 were not provided with the inflatable raft 30, the separable chamber 36 could serve as a flotation device for returning the tank 22 to the surface of the water. Thus, in such an embodiment, the seam 90 could be formed by a quick release cloth fastening of the type also indicated at 82 for the flap 80.

To further facilitate separation of the first chamber 36 from the second chamber 38, the interconnection 64 is preferably provided with a quick release coupling, formed for example, within the one-way check valve 66. Normally, the diver would not separate the two chambers until after the second chamber 38 were inflated through the interconnection 64. However, even if such separation did prematurely occur, inflation of the second chamber 38 could still be carried out manually or through the emergency canister 86.

The manner of operation and use of the device 16 or 16' by the diver 12 is believed readily apparent from the preceding description of the apparatus. However, a typical mode of operation is briefly described below in order to assure a complete understanding of the invention. Initially, with the tank 22, backpack 24 and combined life vest device and buoyancy compensator 16' arranged upon the diver as illustrated for example in FIG. 4, the diver when he is under water operates the power inflator 56 to regulate pressure in the buoyancy compensator chamber 36. Operation in this manner is also illustrated in FIG. 2.

When the diver decides to return to the surface of the water, he initially removes the air tank 22 and backpack 24 by means of the quick release couplings 28 (see FIG. 3). However, before removing the tank 22 or before allowing it to be returned to the surface by the inflatable raft 30, he may employ the power inflator 56 to raise the pressure in the first chamber 36 so that it first opens the check valve 66 and actuates the whistle 64. Continued operation of the power inflator 56 opens the second check valve 68 and permits inflation of the second chamber 38. The diver may also choose to inflate the raft 30 by means of the manual control 99 on the power inflator (see FIG. 2), thereafter allowing the raft 30 to carry the tank 22 and backpack 24 to the surface as illustrated in FIG. 3.

With the second chamber 38 being inflated, it provides buoyancy for the diver to assist him in returning to the surface and/or provides flotation for the diver at the surface as illustrated in FIG. 3.

While the diver is returning to the surface, he may use the air or oxygen in the second chamber 38 through the rebreathing tube 76 under emergency conditions.

It will also be apparent that many different modes of operation for the scuba gear 14 and device 16 or 16' are possible under a variety of diving conditions.

Numerous modifications and variations for the present invention are believed obvious in addition to those specifically referred to above. Accordingly, the scope of the present invention is defined only by the following appended claims.

What is claimed is:

1. A combined life vest device and buoyancy compensator for use by divers along with scuba gear including a compressed air tank to provide an under water source of air, backpack means for mounting the tank on the diver and quick release means for securing the back pack means to the diver and permitting the diver to rapidly free himself of both the backpack and the tank, comprising a garment adapted for fitting about the torso of the diver, buoyancy compensator means comprising a first air-tight chamber formed in the garment closely adjacent the location of the air tank on the diver, means for permitting the diver to selectively regulate pressure within the buoyancy compensator chamber, a second air-tight chamber formed in the garment to generally surround a portion of the diver's torso, and means for selectively inflating the second chamber, whereby the diver is able to regulate pressure within the first buoyancy compensator chamber during a dive, the location of the buoyancy compensator being arranged closely adjacent the tank to maintain the diver's underwater center of gravity while also being in a position to avoid restricting movement of the diver, the second chamber being inflated only as necessary or desired by the diver, the first and second air-tight chambers being of complementary nested configuration, the second air-tight chamber being of a W configuration including an elongated central element arranged to extend along the diver's back and elongated lateral elements arranged to be generally adjacent the front of the diver's torso, the first air-tight chamber being of an inverted U configuration to nest about the elongated central element of the second air-tight chamber in order to be closely adjacent the air tank on the diver.

2. A combined life vest device and buoyancy compensator of claim 1 wherein the garment comprises flexible containers separately forming the first and second air-tight chambers, the garment also comprising inner and outer shells providing abrasion protection for the flexible containers.

3. The combined life vest device and buoyancy compensator of claim 1 wherein the inner shell comprises a wet suit.

4. The combined life vest device and buoyancy compensator of claim 3 wherein said garment comprising said flexible chambers is separable from the wet suit.

5. The combined life vest device and buoyancy compensator of claim 1 wherein the first air-tight chamber comprises an extension arranged to form a cushion behind the diver's head.

6. The combined life vest device and buoyancy compensator of claim 1 further comprising one-way check valve means forming an interconnection between the first and second air-tight chambers while being adapted for permitting pressurization of the second air-tight chamber when pressure in the first air-tight chamber exceeds a first predetermined level.

7. The combined life vest device and buoyancy compensator of claim 6 further comprising a relief valve arranged in communication with the second air-tight chamber and adapted for relieving pressure in the second air-tight chamber when it exceeds a predetermined level higher than the first predetermined level.

8. The combined life vest device and buoyancy compensator claim 6 further comprising a rebreathing tube arranged in communication with the second air-tight chamber to provide an emergency source of air for the diver.

9. The combined life vest device and buoyancy compensator of claim 8 further comprising emergency canister means arranged in the garment for inflating the second air-tight chamber under the control of the diver.

10. The combined life vest device and buoyancy compensator of claim 9 wherein the emergency canister means for the second air-tight chamber is filled with oxygen.

11. A combined life vest device and buoyancy compensator for use by divers along with scuba gear including a compressed air tank to provide an under water source of air, backpack means for mounting the tank on the diver and quick release means for securing the back pack means to the diver and permitting the diver to rapidly free himself of both the backpack and the tank, comprising a garment adapted for fitting about the torso of the diver, buoyancy compensator means comprising a first air-tight chamber formed in the garment closely adjacent the location of the air tank on the diver, means for permitting the diver to selectively regulate pressure within the buoyancy compensator chamber, a second air-tight chamber formed in the garment to generally surround a portion of the diver's torso, means for selectively inflating the second chamber, whereby the diver is able to regulate pressure within the first buoyancy compensator chamber during a dive, the location of the buoyancy compensator being arranged closely adjacent the tank to maintain the diver's underwater center of gravity while also being in a position to avoid restricting movement of the diver, the second chamber being inflated only as necessary or desired by the diver, one-way check valve means forming an interconnection between the first and second air-tight chambers while being adapted for permitting pressurization of the second air-tight chamber when pressure in the first air-tight chamber exceeds a first predetermined level, and a second one-way check valve arranged in series with one first one-way check valve between the first and second air-tight chambers, indicator means being arranged between the first and second one-way valves to provide a signal to the diver prior to inflation of the second air-tight chamber.

12. The combined life vest device and buoyancy compensator of claim 11 further comprising a rebreathing tube arranged in communication with the second air-tight chamber to provide an emergency source of air for the diver.

13. The combined life vest device and buoyancy compensator of claim 12 further comprising emergency canister means arranged in the garment for inflating the second air-tight chamber under the control of the diver.

14. The combined life vest device and buoyancy compensator of claim 13 wherein the emergency canister means for the second air-tight chamber is filled with oxygen.

15. Scuba gear for use by divers and the like, comprising a compressed air tank to provide an underwater source of air for the diver, backpack means for securing the tank to the diver, the backpack means comprising quick release means for permitting the diver to rapidly free himself of the tank, a buoyancy compensator means comprising a first air-tight chamber arranged closely adjacent the tank, means for selectively regulating pressure within the first chamber under the control of the diver, a second air-tight chamber arranged to generally surround a portion of the diver's torso, and a one-way check valve providing an interconnection between the first and second air-tight chambers in order to automatically inflate the second air-tight chamber when pressure in the first air-tight chamber exceeds a first predetermined level, separate flexible containers forming the first and second air-tight chambers, inner and outer shell means providing abrasion protection for the first and second air-tight chambers respectively, the second air-tight chamber being separable from the first chamber in order to remain with the backpack and air tank when they are removed by the diver.

16. The scuba gear of claim 3 wherein the first air-tight chamber comprises an extension arranged to form a cushion behind the diver's head.

17. The scuba gear of claim 15 further comprising a release valve arranged in communication with the second air-tight chamber and adapted for relieving pressure in the second air-tight chamber when it exceeds a second predetermined level higher than the first predetermined level.

18. The scuba gear of claim 17 further comprising a second one-way check valve arranged in series with the first one-way check valve between the first and second air-tight chambers, indicator means being arranged between the first and second one-way valves to provide a signal to the diver prior to inflation of the second air-tight chamber.

19. The scuba gear of claim 18 further comprising disconnect means associated with one of the check valves to facilitate separation of the two air-tight chambers.

20. The scuba gear of claim 15 further comprising a rebreathing tube arranged in communication with the second air-tight chamber to provide an emergency source of air for the diver.

21. The scuba gear of claim 20 further comprising emergency canister means arranged in the garment for inflating the second air-tight chamber under the control of the diver.

22. The scuba gear of claim 21 wherein the emergency canister means for the second air-tight chamber is filled with oxygen.

* * * * *